United States Patent [19]

Cook et al.

[11] Patent Number: 4,909,253

[45] Date of Patent: Mar. 20, 1990

[54] PACIFIER FOR INFANTS

[76] Inventors: Linda L. Cook, 70 Laurelwood Rd., Woodbury, Conn. 06798; Marie O. Sabo, 193 Carmen Hill #2, New Milford, Conn. 06776; Theresa K. McDougall, 15 Overlook Dr., New Milford, Conn. 06776; Adeline Cursio, 68 Levonia Rd., Patterson, N.Y. 12563

[21] Appl. No.: 284,716

[22] Filed: Dec. 15, 1988

Related U.S. Application Data

[63] Continuation of Ser. No. 61,484, Jun. 15, 1987, abandoned.

[51] Int. Cl.[4] ..... A61J 17/00

[52] U.S. Cl. ..... 606/234

[58] Field of Search ..... 128/359, 360; D.24/45, D.24/46

[56] References Cited

U.S. PATENT DOCUMENTS

| | | | |
|---|---|---|---|
| D. 194,769 | 3/1963 | Moffat | 128/360 X |
| D. 249,161 | 8/1978 | Rohrig | 128/360 X |
| D. 285,839 | 9/1986 | Roehrig | D24/45 |
| D. 295,073 | 4/1988 | Ford | D24/45 |
| 699,757 | 5/1902 | Howell | 128/360 |
| 2,665,693 | 1/1954 | Pecora | 128/360 |
| 3,601,129 | 8/1971 | Seidl | 128/360 |
| 3,669,112 | 6/1972 | Mager et al. | 128/360 |
| 3,923,067 | 12/1975 | Hurst | 128/360 |
| 4,195,638 | 4/1980 | Duckstein | 128/360 |

*Primary Examiner*—Michael H. Thaler
*Attorney, Agent, or Firm*—Richard A. Craig

[57] ABSTRACT

It is provided an improved pacifier having a nipple section, a perforated guard section and a handle section, wherein said nipple section is devoid of any enlargement at the tip, said guard section may be circular or may have the shape of two fused circles, and said handle section is of semicircular shape preferably not forming a ring type structure; said nipple section, guard section and handle section forming an integral unit.

6 Claims, 1 Drawing Sheet

PACIFIER FOR INFANTS

This is a continuation of application Ser. No. 061,484, filed 6/15/87, now abandoned.

BACKGROUND OF THE INVENTION

The use of pacifiers for small children has been the custom for many years, and numerous pacifiers have been commercially available having a variety of sizes, shapes, consistencies and other characteristics. However, it has been found that many of such pacifiers designed with all good intentions ultimately fail the test by the user, i.e. they are rejected by the infants for one reason or other, such reasons usually being traceable to shape, size, consistency, weight or the like. It has been found that especially infants born prematurely are very difficult to satisfy, and for all practical purposes there is, to the best of our knowledge, not one pacifier on the market that has been found satisfactory for the premature baby.

Typical pacifiers are reflected by the disclosures of certain references of interest:

U.S. Pat. No. 3,669,112 (Mager et al) deals with a one-piece pacifier having a bag shaped sucking portion somewhat enlarged at its tip, a circular or disc-shaped lip guard, and a base extension which which may be penetrated by bore holes for the purpose of, for instance, inserting a ring; it is alleged that due to the strongly curved closing surfaces; of the base extension, it is avoided that an infant uses the wrong end of the pacifier. No mention is made of a lip guard or of the sucking portion being devoid of enlargement at its tip.

U.S. Pat. No. 3,825,014 (Wroten) provides a one-piece pacifier having a hollow nipple portion, a lip guard and a ring; said nipple portion being enlarge at its tip and carrying several ridges on the inside surface.

U.S. Pat. No. 3,923,067 (Hurst) teaches a baby soother comprising interlocking teat, ring and shield portions, the latter bonding together the two former elements. There is no mention made of perforations in the shield or the teat being without an enlarge tip section.

U.S. Pat. No. 4,132,232 (Lerner) describes a pacifier having a nipple, a guard and a ring portion, wherein said nipple has a enlarged shape towards its tip and is penetrated by holes allegedly for improved safety from choking; no perforations are contempleted for the guard member.

U.S. Pat. No. 4,403,613 (Panicci) deals with a one-piece pacifier having a non-symmetrical nipple to which is attached a shield, the latter being of a curved shape to allegedly minimize infant's chin irritation; a handle is also provided which is angled downwards towards the curved lower portion of the shield. There is no indication that the shield has to carry perforations or that the nipple be of cylindrical shape without an enlarged tip.

U.S. Pat. No. 4,545,378 (Chrones) describes a two-piece pacifier wherein the baglet plus handle portion carries two bevelled collars allowing securing a shield within the space provided by said collars. Although two relief openings are indicated in the shield, a multiplicity of perforations is neither mentioned nor anticipated, and the nipple has the conventionally enlarged tip shape.

SUMMARY OF THE INVENTION

It is the object of this invention to provide a pacifier that is suitable for use by infants;

It is a further object of this invention to provide a pacifier that is especially useful for prematurely born infants;

It is still a further object of this invention to provide a pacifier which is safe yet effective;

Another object of this invention rests with the particular shape of the pacifier, i.e. it devoid of any enlargement at its tip;

It is an additional object of this invention to provide a pacifier for infants which incorporates a lip guard carrying a multiplicity of perforations in order to facilitate ease of ventilation of infant's skin when in use;

It is still a further object of this invention to provide a pacifier which is substantially of one-piece construction and which is readily pliable.

Other objects of this invention shall become apparent in the ensuing description and appended claims.

BRIEF DESCRIPTION OF THE DRAWINGS

FIG. 4 is a top FIG. 1 view of; and

DETAILED DESCRIPTION OF THE INVENTION

Figure 1:
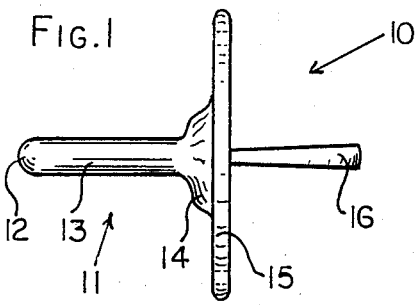
FIG. 1 is an elevated side view of a pacifier of this invention.
Figure 2:
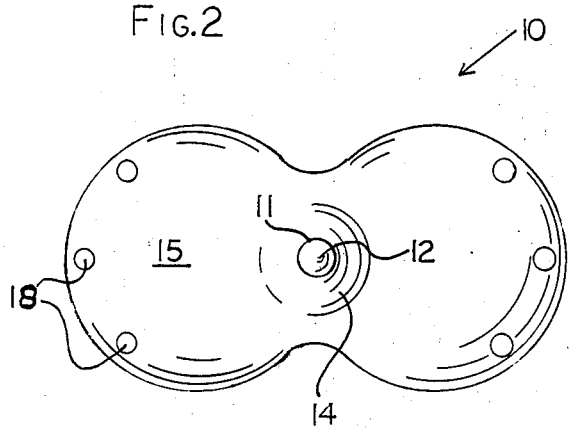
FIG. 2 is an elevated front view of FIG. 1.
Figure 3:
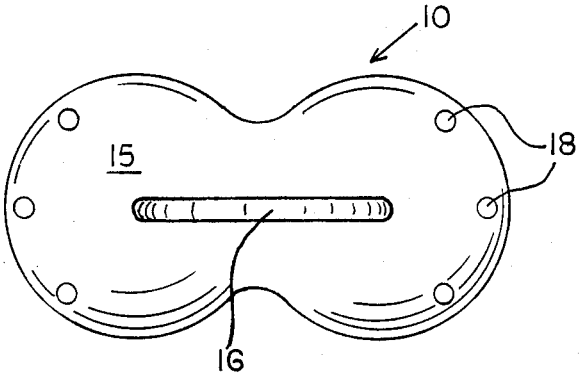
FIG. 3 is an elevated back view of FIG. 1.
Figure 4:
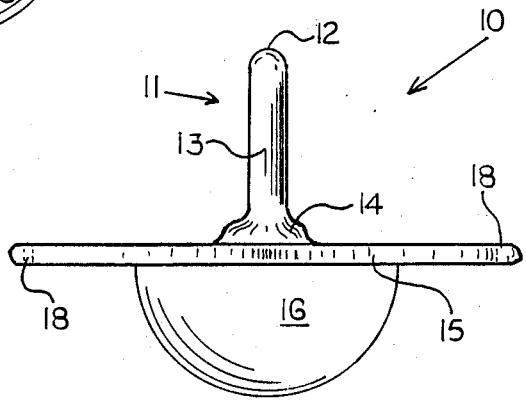

In FIG. 1, 2, 3 and 4 there is described pacifier 10 of this invention having a nipple section 11 formed by the hemispherical tip portion 12, an elongated cylindrically shaped middle portion 13 and a flared ridge portion 14, the latter serving as a transition from nipple section 11 to guard section 15, said guard section 15 having the approximate shape of two fused circles and carrying therethrough perforations 18, said perforations allowing ventilation of infant's skin; opposite to the nipple section 11 there is connected with the center of the guard section 15 semi-circular handle section 16, all three sections, i.e. nipple section 11, guard section 15 and handle section 16 essentially forming one integral unit.

Figure 5:
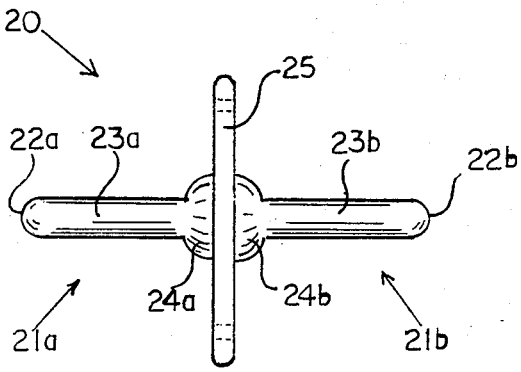
FIG. 5 is a elevated side view of another embodiment of this invention.

A modification of the pacifier of this invention is shown in FIG. 5 which comprises a guard section 25 having attached thereto on either side nipple sections **21*a* and 21*b*, the latter being formed by tip portions 22*a* and 22*b* and elongated cylindrical portions 23*a* and 23*b*, respectively, each such nipple section 21*a* and 21*b* being attached to either side of said guard section 25 via respective flared transitional ridge portions 24*a* and 24*b***; it will be noted that a specific handle section is missing in this so-called double-ended pacifier, one or the other of the nipple sections possibly serving both, namely as a means for sucking and handling. This construction has the advantage that the infant may use either end of the pacifier reducing the chances of the infant being disturbed by the loss of the pacifier nipple.

There are several advantages connected with the pacifier of this invention, all carefully incorporated in the construction thereof. As already mentioned, the guard section may carry a multiplicity of perforations, i.e. preferably four, more preferably six or even more such perforations assuring adequate ventilation to the infant's skin when in use, yet, the perforations preferably ought be so small so as to make it difficult to attach any strings, chains or the like to such pacifier. The nipple section is formed into a unique shape wherein any enlargement of the forward or tip portion is avoided, it having been found that especially prematurely born infants seemingly cannot cope with pacifiers suggested by the prior art or being available in the market place. A further advantage may be found in the fact that preferably the pacifier of this invention has no ring type handle or any opening that may lend itself to having a string etc. attached thereon; such string being an obvious hazard to an infant possibly causing inadvertent strangulation. Still another advantage is the shape of the guard section, which may be circular, but in a much preferred mode has about the shape of two fused circles leaving room for nose and chin, respectively, in the inwardly curved portions of said guard. Since there are two such identical indentations, the pacifier of this invention may be used in either fashion, making it much easier for the infant to cope with the pacifier especially if the infant is kept in an incubator or with a respirator. It should be understood that such guard section may be flat or slightly curved away from the nipple section.

It is desirable that the pacifier is of a permanent single, unitary construction incapable of being taken apart without undue force, yet, the pacifier should be made from pliable, flexible material throughout such as from natural or synthetic elastomers including natural rubber, cispolyisoprene, cis-polybutadiene, poly(butadiene-styrene), polyurethane, poly(ethylene-propylene) copolymer or poly (ethylene-propylene-non-conjugated diene) terpolymer, butyl rubber, and the like. Such flexibility and/or pliability may further be enhanced by incorporating a hollow space within at least the nipple section and possibly extending to the guard or handle sections.

The size of the sections of the pacifier of this invention may of course be varied depending essentially on the age of the infant; at the same time care should be taken that the guard section of the pacifier be kept large enough so as to prevent the infant to insert the whole pacifier in its mouth causing possible choking.

The length of the nipple section, excluding the flared ridge portion, may range from 0.5–2.0 inch, preferably 0.75–1.5 inch and most preferably 0.75–1.25 inch.

The thickness of the elongated middle portion may be 0.125–0.5 inch, preferably 0.25–0.5, and most preferably 0.25–0.4 inch, care to be taken that the hemispherical tip has the same thickness as said middle portion.

The flared ridge portion may have a maximum diameter of 0.25–1.0 inch, preferably 0.30–0.75, and most preferably 0.5–0.625 inch, whereas the length of said ridge portion may be 0.2–1.0 inch, preferably 0.25–0.75 inch.

The guard and handle sections may have a thickness of 0.1–0.35 inch, preferably 0.125–0.3 inch, with the maximum width being 1.5–5 inch, preferably 1.75–4 inch and most preferably 2–3 inch, whereby the width of the guard handle at the narrowest points of indentation may be 0.75–2 inch, preferably 1–1.5 inch, most preferably 1–1.25 inch.

Having disclosed the invention, there may be other variations and modifications not specifically mentioned but falling well within the spirit and claims of this invention.

What is claimed is:

1. A flexible and pliable infant pacifier of single, unitary construction comprising a nipple section, a guard section and a handle section; said nipple section comprising a hemispherical tip portion, a cylindrical middle portion and a flared and outwardly bulging ridge portion, wherein the outside diameter of said tip portion and the outside diameter of said middle portion are the same; said guard section having perforations of a size making it difficult to attach a string, chain or the like thereto; and said handle section having a semi-disc like configuration.

2. The pacifier of claim 1 wherein said guard section has a circular shape.

3. The pacifier of claim 1 wherein said guard section has the shape of two fused circles.

4. The pacifier of claim 1 wherein said handle section is tapered towards said guard section.

5. The pacifier of claim 1 wherein said guard section has at least four perforations.

6. The pacifier of claim 1 wherein said guard section has at least six perforations.

* * * * *